US006080037A

United States Patent [19]

Lee et al.

[11] Patent Number: 6,080,037

[45] Date of Patent: Jun. 27, 2000

[54] BRASSIERE

[76] Inventors: In-Han Lee, 506-Ho, 125-Dong, Jugong Apartment, Jamsil-Dong, Songpa-Ku, Seoul; Byung-Up Ko, 110-302, Daewoo Utopia Apartment, 499 Obang-Dong, Kimhae-City, Kyungsangnam-do, both of Rep. of Korea

[21] Appl. No.: 09/208,983

[22] Filed: Dec. 11, 1998

[30] Foreign Application Priority Data

Jul. 23, 1998 [KR] Rep. of Korea ..... 98-29603

[51] Int. Cl.[7] ..... A41C 3/00

[52] U.S. Cl. ..... 450/38; 450/57; 450/1; 2/67

[58] Field of Search ..... 450/38, 1, 57; 2/67, DIG. 3, 267

[56] References Cited

U.S. PATENT DOCUMENTS

| | | | |
|---|---|---|---|
| 2,597,924 | 5/1952 | Davenport et al. | 2/267 |
| 2,697,229 | 12/1954 | Krueger | 2/267 |
| 2,764,759 | 10/1956 | Gazelle | 450/38 |
| 2,826,202 | 3/1958 | Star | 450/38 |
| 4,222,387 | 9/1980 | Tetu . | |
| 4,734,078 | 3/1988 | Moreau . | |
| 5,050,595 | 9/1991 | Krafft | 450/38 |
| 5,215,494 | 6/1993 | Flannagan . | |
| 5,347,656 | 9/1994 | Fabritz et al. | 2/67 |
| 5,823,852 | 10/1998 | Chu | 450/38 |
| 5,833,515 | 11/1998 | Shahbazian et al. | 450/38 |
| 5,899,790 | 5/1999 | Berg | 450/57 |

*Primary Examiner*—Gloria M. Hale

[57] ABSTRACT

A pneumatically adjustable brassiere re-shapes drooping or small breasts. The brassiere includes brassiere cups of a conventional shape and are respectively composed as an integral body with a first tube made of soft synthetic resin containing a predetermined amount of ceramic material, antibiotics, and deodorizer particles and connected with a feed valve. A second tube is separately connected with an air blowing pump. The first tube has several protrusions for finger pressure therapy and several vents on an inner surface thereof. The feed valve includes a valve sheet for intake of air into the valve body with alternately opening inflow holes on the valve body, two highly elastic springs and corrugated air pumps to vibrate up and down according to a wearer's movement so as to automatically supply air to the first air tube. The second tube is able to inflate and deflate in accordance with a degree of air-supply from the air blowing pump, thereby controlling an amount of air supplied to the second tube of each brassiere cup.

13 Claims, 11 Drawing Sheets

BRASSIERE

BACKGROUND OF THE INVENTION

1. Field of the Invention

This invention relates to an improved brassiere for a woman who wants to beautify the drooped breasts or small breasts, and particularly speaking, which is able to complement and compensate for such a defect of the breasts.

2. Disclosure of Related Art

A brassiere is worn to protect and to prevent breasts from drooping but since it primarily comprises an elastic band, the conventional brassiere strongly presses against the chest of a wearer. So, if a wearer wears the conventional brassiere for a long time, she feels uncomfortable because of the pressure of the elastic band and also because the ventilation of the brassiere is not good. Accordingly, the above such effects badly affect the wearer's skin.

The conventional brassiere provides the above stated functions only to breasts of the female. However, females who wear brassieres in practice require other functions such as to complement the shape of small breasts or drooped breasts and the like. Since these functions are rarely addressed, the quality of goods for sale to these women falls off.

SUMMARY OF THE INVENTION

The present invention intends to solve the problems of conventional brassieres and the object of the present invention is to provide an improved brassiere which complements the shape of small breasts and drooped breasts and at the same time makes the wearer feel good by providing ventilation and enhancing hygiene of the brassiere.

BRIEF DESCRIPTION OF THE ATTACHED DRAWINGS

The accompanying drawings, which are included to provide a further understanding of the present invention and are incorporated in and constitute a part of this specification, illustrate the preferred embodiments of the present invention and together with the description serve to explain the principles of this invention.

In the drawings:

FIG. 1 through FIG. 3 illustrate a first preferred embodiment of the present invention wherein, FIG. 1 is a partially exploded perspective view;

FIG. 2 is an exploded perspective view showing the structure of a brassiere cup in the present invention;

FIG. 3 is a sectional view showing an internal structure of a feed valve of the present invention;

FIG. 4 through FIG. 7 illustrate a second preferred embodiment of the present invention wherein, FIG. 4 is a rear perspective view exploded partially;

FIG. 5 is a longitudinal sectional view showing the internal structure of the brassiere of the present invention;

FIG. 6 is a perspective view of an air tube in the present invention;

FIG. 7 is an enlarged sectional view showing one end of a feed tube in the present invention;

FIG. 8 through FIG. 12 illustrate a third preferred embodiment of the present invention wherein, FIG. 8 is a perspective view exploded partially;

FIG. 9 is a perspective view of an air bag;

FIG. 12 is an exploded perspective view of a valve member.

DETAILED DESCRIPTION OF THE PREFERRED EMBODIMENT

Figure 1:
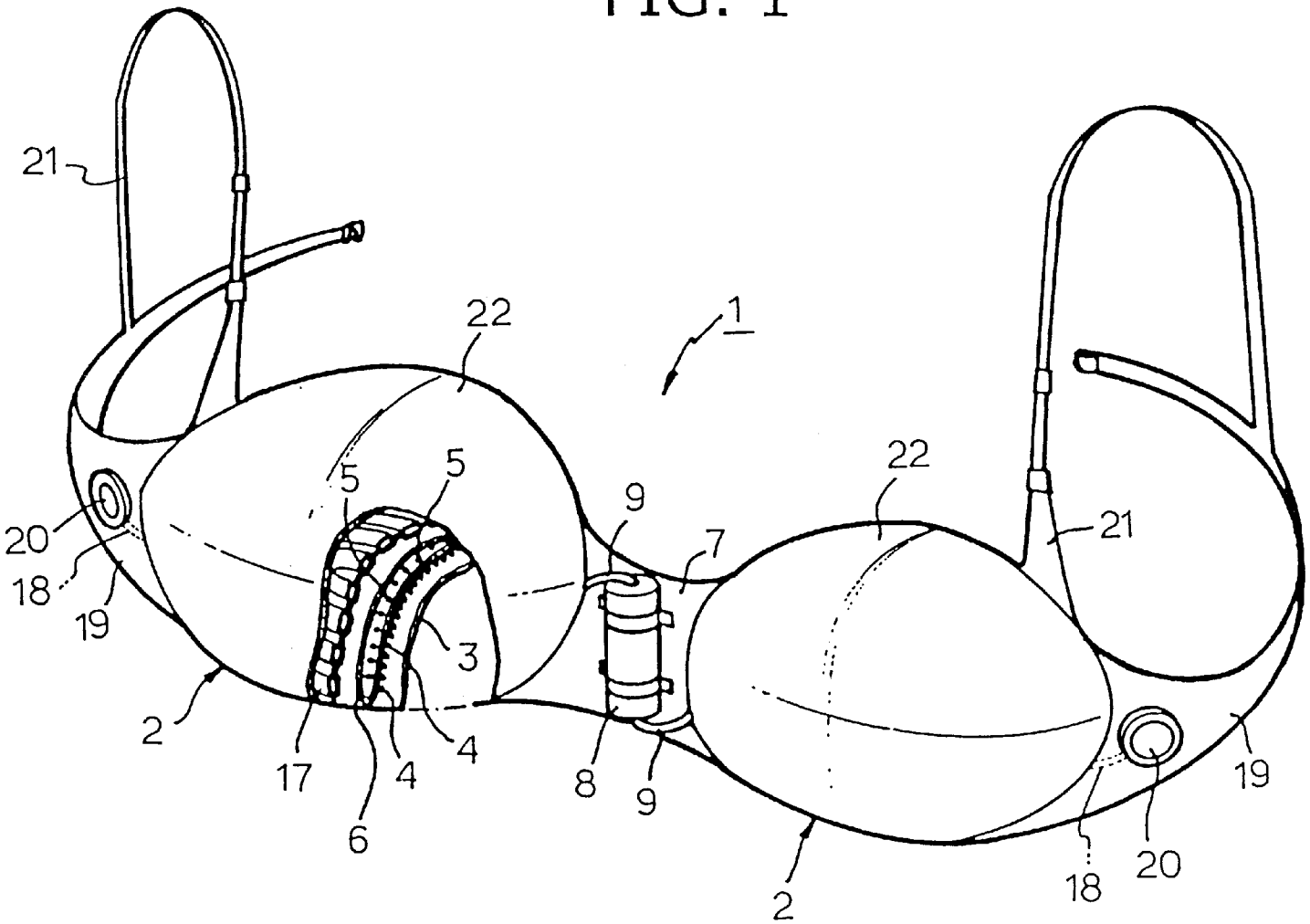

Referring to the drawings attached herewith, a preferred embodiment of the present invention shall be described in detail.

Figure 2:
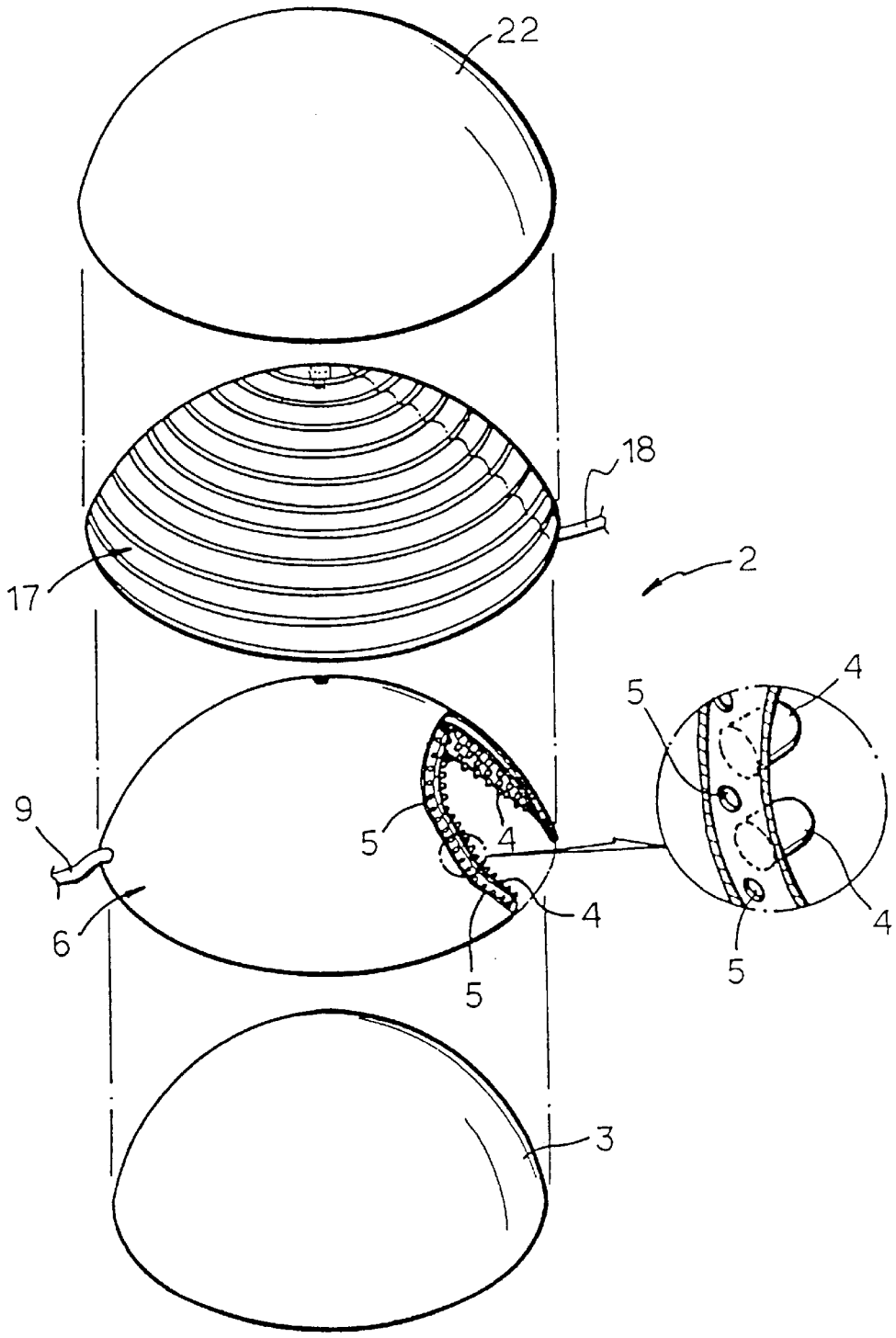
Figure 3:
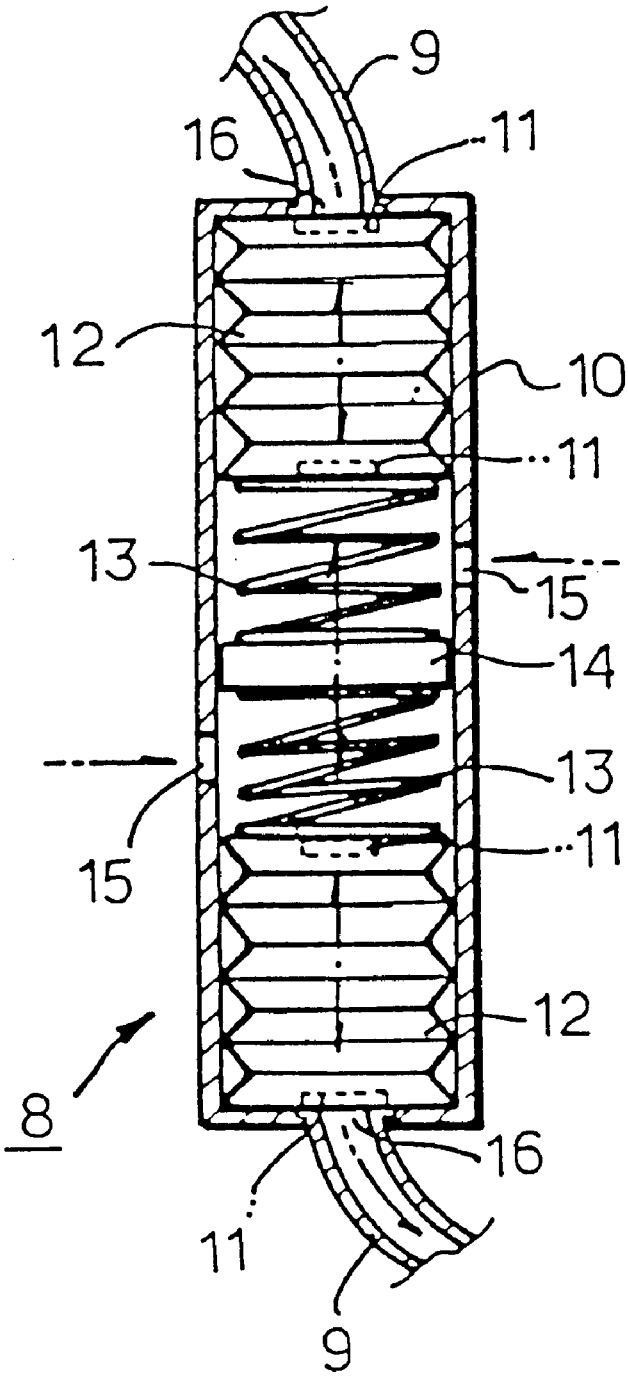
Figure 4:
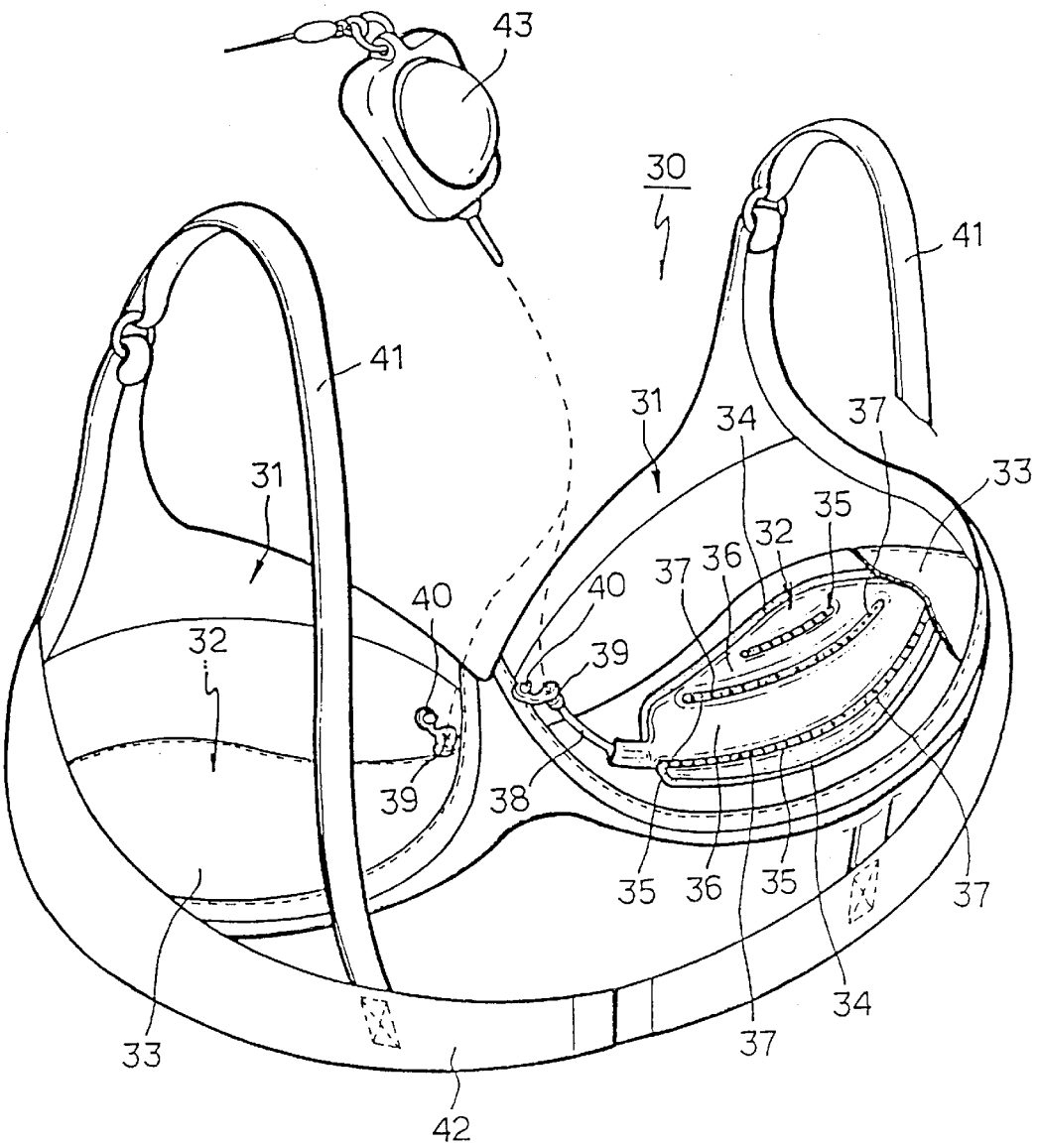
Figure 5:
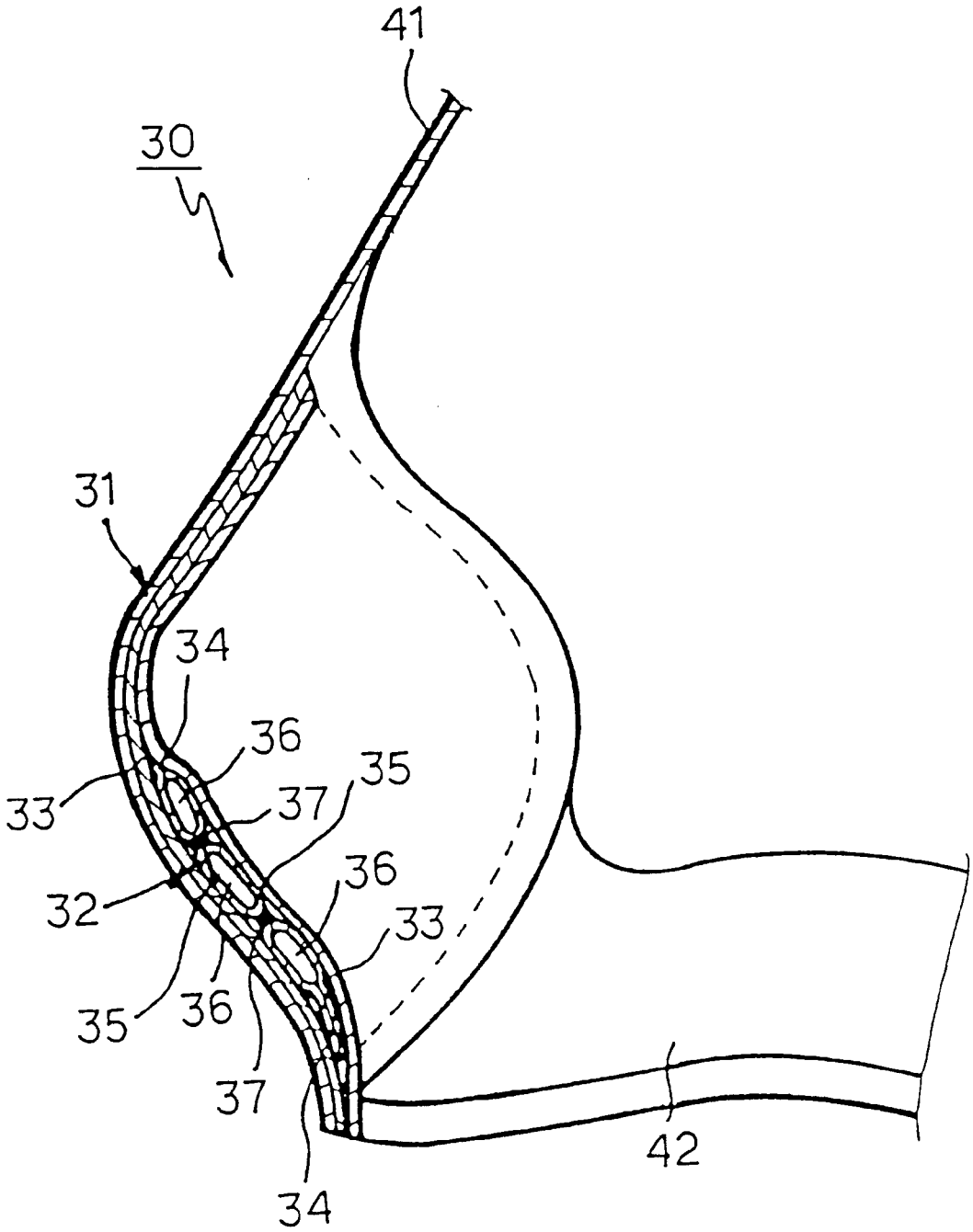
Figure 6:
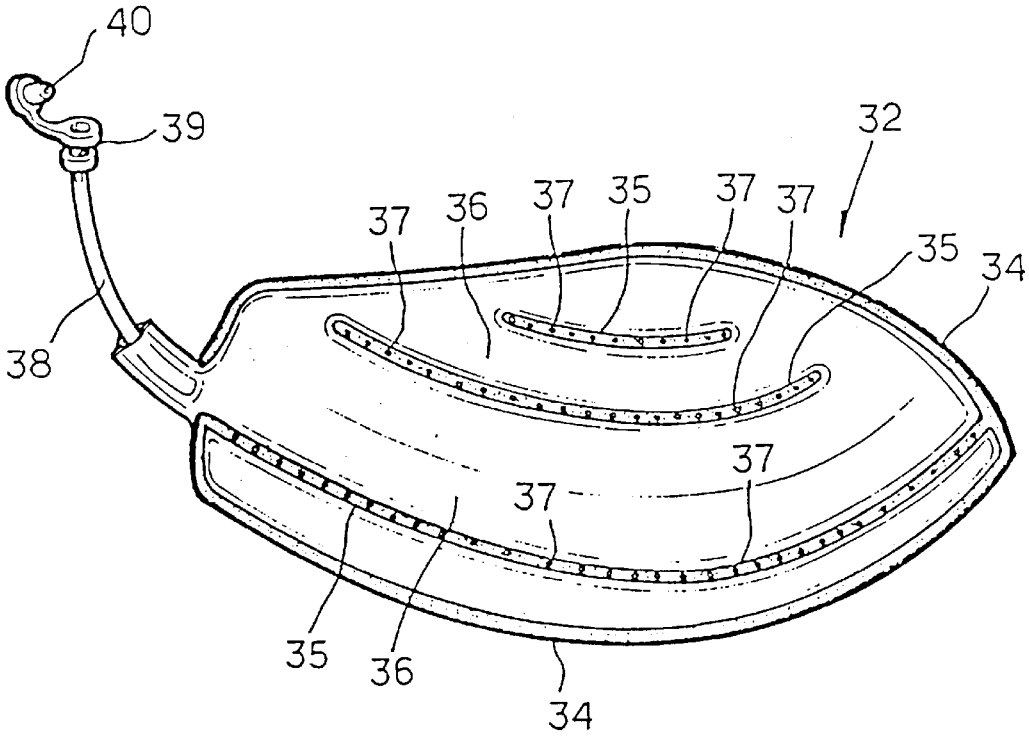
Figure 7:
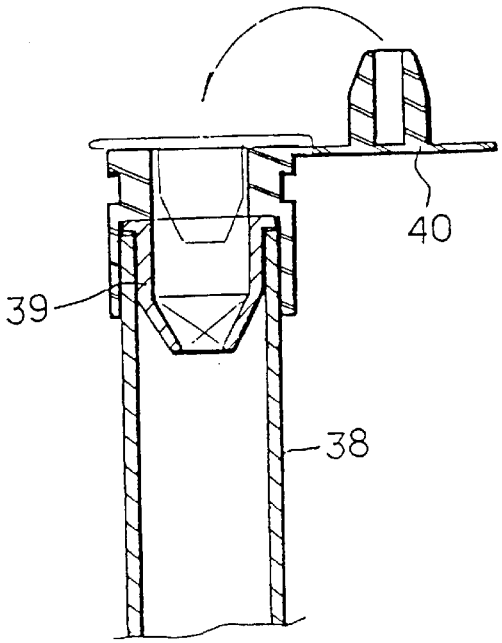
Figure 8:
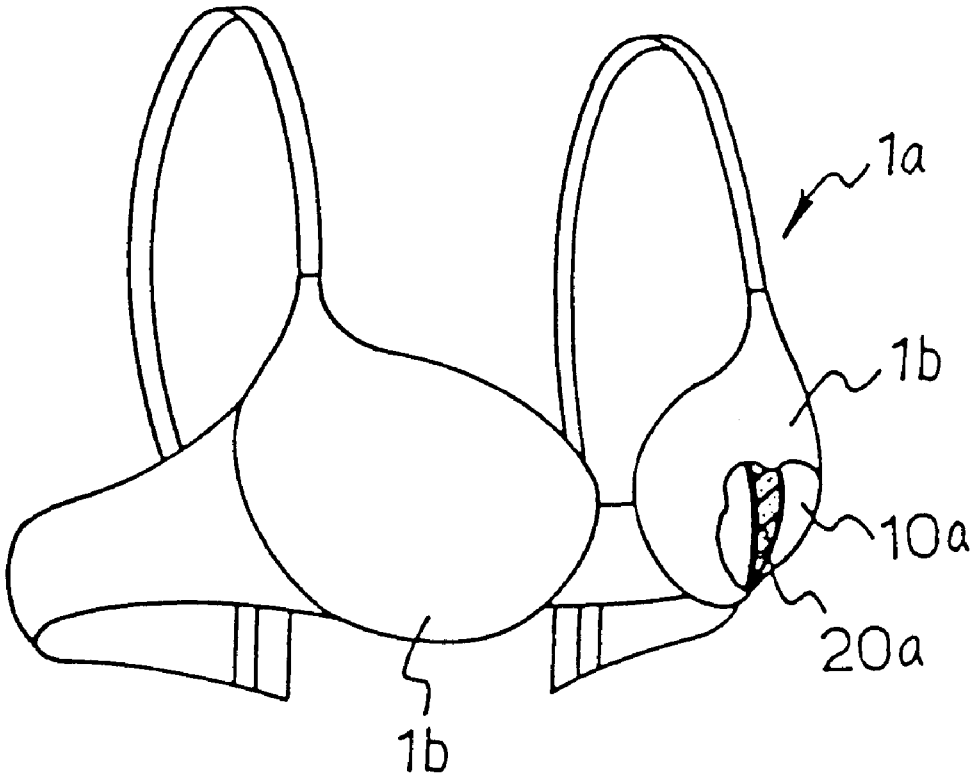
Figure 9:
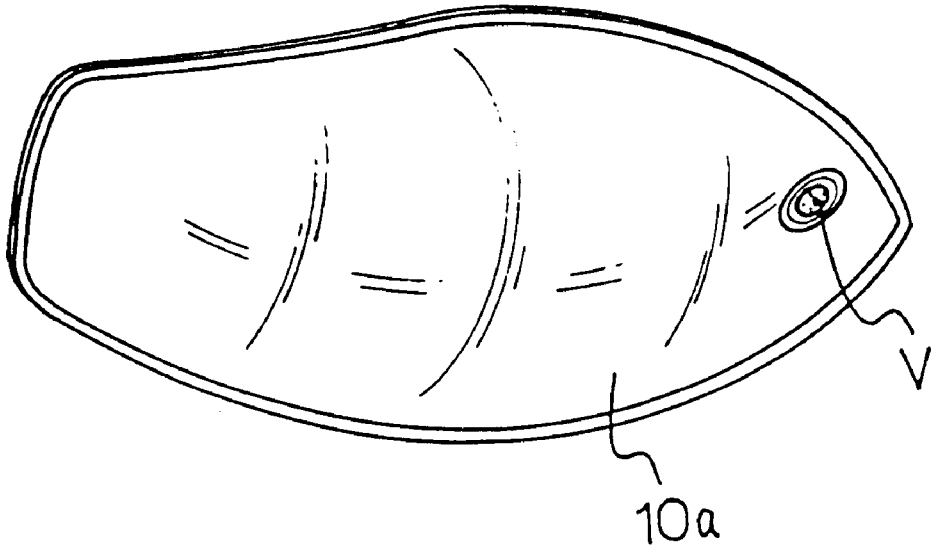

FIG. 1 through FIG. 3 illustrate a first preferred embodiment of the present invention.

In the brassiere 1 shown in the first preferred embodiment, two brassiere cups 2 receiving, protecting and supporting both sides of each breast elastically, have respectively, starting from a face contacting with the breast, an inside cover 3 made of natural fiber such as cotton and a first tube 6 made of soft synthetic resin such as PVC, etc. The first tube 6 has several protrusions 4 for finger-pressure therapy and several vents 5 and is formed to be semi-spherical in shape. The above brassiere 1 also has a feed valve 8 which is installed in the middle of two brassiere cups 2 and a connecting hose 9 which communicates the first tube 6 with the above air feed valve 8.

In forming the above first tube 6, ceramic material particles radiating far infrared rays and the well known antibiotics and deodorizer for removing bad smell and destroying germs occurring from the human body are properly added thereinto.

As shown in FIG. 3, the air feed valve 8 includes two corrugated air pumps 12 each of which has a check valve 11 up and down; two highly elastic springs 13 between the air pumps 12; a valve sheet 14 elastically installed between springs and being able to vibrate up and down; two inflow holes 15 punched on the middle both sides of the valve body 10 and through which air can flow into the valve body 10; and two out flow holes 16 formed respectively on the top and the bottom of the valve body 10 and through which air can flow out from the valve body 10 by compressing the corrugated air pump 12 formed into a cylindrical shape and sealed up within the air supplying valve body 10. Also, the above feed valve 8 is connected with the connecting hose 9 so that air can be supplied into the first tube 6.

The brassiere in the first preferred embodiment also has a second tube 17 installed outwardly of the first tube 6 and made of soft synthetic resin such as PVC, etc., so as to be inflatable or deflatable to proper volume. As shown in FIG. 1 and FIG. 2, the said second tube 17 is connected with a connecting hose 18 in right and left sides of the brassiere cup 2 and is communicates with an air blowing pump (20 installed on an elastic band 19 of the brassiere cup 2. Reference numeral 21 shows a shoulder band attached to the brassiere 1 and 22 shows an outside cover of the cup 2.

The brassiere of the first preferred embodiment composed as described above is worn such that shoulder bands 21 are draped over one's shoulder and ends of elastic bands 19 are hooked on one's back. In this case, the brassiere cups 2 cover and protect both breasts with proper force naturally and also the brassiere cups 2 according to the present invention has the following functions and distinguished effects.

That is, when the brassiere 1 of the present invention is worn, the wearer can obtain the remedial effect since the ceramic material particle included in the first tube 6 radiates infrared rays. Also, bad smells and germs owing to secretion from human body such as sweat, etc., can be removed and destroyed because of the antibiotics and deodorizer added within the first tube 6 in the forming step.

More specifically, when the wearer is walking or moving her upper body, the first tube 6 can supply air from the outside to the inside of the brassiere cup 2, that is, to the chest of the brasierre, so that it makes the wearer feel comfortable to the wearer and ventilates air smoothly. That is, this air supply is done by the following structure. The first tube 6 is connected to a feed valve 8 attached to the middle part 7 between two brassiere cups 2 through a connecting hose 9 and thus whenever the upper body of wearer is moved a little, the feed valve 8 introduces air in the first tube 6.

More particularly, the air supply is as follows. Within the valve body 10 of the feed valve 8, a valve sheet 14 is installed between two elastic springs 13 and two corrugated air pumps 12 are installed at the upper and lower sides of the elastic springs 13. Therefore, when the valve body 10 moves, the valve sheet 14 inside thereof vibrates into either upper or lower side. At this time, air from outside alternately flows into the valve body 10 through the inflow holes 15 and at the same time the inflow air is supplied to the first tube 6 through the out flow hole 16 and the connecting hose 9 by alternately opening or closing the check valve 11 of the corrugated air pump 12. The air supplied into the first tube 6 is ventilated into the chest part through a plurality of air vents 5 punched in the first tube 6 and inside cover 3 made of natural fiber such as cotton, etc. Several protrusions 4 is formed in the inside of the first tube 6 so that the protrusions 4 give the finger-pressure treatment to the wearer's chest part. Therefore, through the finger-pressure treatment, the wearer can improve the circulation of blood, and the like.

The brassiere of the present invention can cover small breasts, if necessary, when a female who has small breasts wears it. In this case, the second tube 17 attached to the front of the first tube 6 can have air blown thereinto and be inflated to a proper size whereby the small breasts are complemented.

In this case, the air blowing pump 20 installed on the elastic band 19 of the right and left of brassiere cups 2 and connected with the second tube 17 through the connecting hose 18 is operated, and thus air of the proper amount is blown into the second tube 17.

On the contrary, if not necessary, the air blowing pump 20 can be operated to be opened so that air is compressed and the second tube 17 can keep the smallest volume. The structure and function of the above air blowing pump 20 are well known to all. Therefore, detailed explanation therefor is omitted.

As mentioned above, the improved brassiere 1 shown in the first preferred embodiment of the present invention has effects such as the ventilation, the finger-pressure treatment and remedial operation by the far infrared rays.

Also it includes the first tube 6 and the second tube 17 that can inflate to the proper volume so as to complement small breasts of wearers.

FIG. 4 to FIG. 7 illustrate a second preferred embodiment of the present invention.

The brassiere 30 showing in a second preferred embodiment has an air-tube body 32 inside of the brassiere cup 31 protecting and elastically supporting both breasts of a wearer. The air-tube body 32 is inflatable and deflatable according to blowing air thereinto. The air-tube body 32 situated between ventilative inner and outer covers 33 is made of silicone and the like, and is formed by adding proper amounts of ceramic material particles, antibiotics and deodorizer to the silicone as a main material.

The shape of the air-tube body 32 contours with and is the same shape as the lower part of the brassiere cup 31. The air-tube body 32 is communicates with all air chambers as one body by means of an adhesive portion 34 surrounding an outside thereof and it also includes inside adhesive portions 35 that allow equal distribution of air. The inside adhesive portions 35 have several vents for ventilation thereon.

The air-tube body 32 communicates with an introducing tube 38 for inflation and deflation of air. The end of the introducing tube 38 is sited near the upper-end of a brassiere cup 31 and, a check valve 39 and a cap 40 for opening or closing are attached thereto. Reference number 41 shows shoulder bands attached to the brassiere 30, 42 shows elastic bands attached to the brassiere 30 and 43 shows manual pump for pumping air thereinto.

The brassiere of the second preferred embodiment composed as described above is also worn such that the shoulder bands 41 are draped over one's shoulders and ends of the elastic bands 42 are hooked on one's back. In this case, the brassiere cups 31 cover and protect both breasts with proper force naturally and also the brassiere cup 31 of the present invention has the following functions and distinguishing effects as the first embodiment mentioned above.

That is, when the brassiere 30 of the present invention is worn, the wearer can get far infrared rays of remedial value since the ceramic material particle radiates a substantial amount of infrared rays. Also, bad smells and germs due to secretion from the human body such as sweat, etc., can be removed and destroyed because of the antibiotics and deodorizer added in forming the air-tube body 32.

The air-tube body 32 sited inside of the brassiere cup 31 can be properly inflated by blowing air according to a wearer's necessity and it can support and complement the wearer's small and/or drooped breasts so as to beautify the shape.

To blow air into the air-tube body 32, first of all open the cap 40 for opening or closing connected to the end of the introducing tube 38 and then inflate air through the check valve 39 of the end of the introducing tube 38 by means of a manual pump 43 or the wearer's mouth. The air blown into the air chamber 36 of the air-tube body 32 through the introducing tube 38 keeps the full state by means of the check valve 39. After completing the air inflation into the air chamber 36, the cap 40 for opening or closing blocks the end of the introducing tube 38 thereby preventing air from leaking.

Thus, the brassiere cup 31 having the lower part thereof in a full state by means of the inflated air-tube body 32 not only perfectly supports drooped breasts but also complements the shape of small breasts.

To deflate air from the air-tube body 32, after opening the cap 40 for opening or closing, press the check valve 39. Then the check valve 39 becomes opened and thereby the air in the air-tube body 32 is compressed by its air pressure therein.

For ventilation in the summer season, several vents 37 are punched through on inside adhesive portions 35 of the air-tube body 32. The air-tube body 32 is covered with an inner and outer cover 33 and installed inside of the brassiere cup 31. The inner and outer covers 33 are the material which has excellent ventilation. Thereby, the air-tube body 32 covered with the cover 33 can help the wearer's skin to be kept good condition.

As described above, the improved brassiere 30 shown in the second preferred embodiment of the present invention is composed of an air-tube body 32 having excellent ventilation, a remedial operation to with far infrared rays and, removal bad smell and germ destruction in a conventional brassiere cup 31, and in case of need, the air-tube body 32 can be inflated to a proper volume by blowing air thereinto and thereby supporting the lower part of drooped breasts and complementing small breasts. That is, the air-tube body 32 complements beautifully the shape of the small and drooped breasts. Also, this improved brassiere 30 of the present invention comprises the minimum components within the limit to obtain the substantial effect, so there are lots of expected such as cost reduction effect and the like.

FIG. 8 through FIG. 12 illustrate the third preferred embodiment of the present invention.

The brassiere 1*a* shown in the third preferred embodiment has an air-tube 10*a* installed inside of the brassiere cup 1*b*; a highly elastic sponge 20*a* contouring a curved front face and inflating the air-tube 10*a* under the installed condition therein; and a valve member V airtightly installed on a vent 11*a* of said air-tube 10*a* whereby it opens or closes said vent 11*a*.

The shape of said air-tube 10*a* contours to almost same shape with the brassiere cup 1*b* of the brassiere 1*a*. Edges of the front and rear of the air-tube 10*a* are airtightly co-sealed whereby a receiving space for the sponge 20*a* is provided within said air-tube 10*a* and a vent 11*a* is punched at one side of said air-tube 10*a*. It is desirable that in forming the above air-tube 10*a*, ceramic material particles, antibiotics and deodorizer should be put into the polyurethane, silicone and the like which are harmless to the human body.

A highly elastic sponge is used as the above sponge 20*a* in order to inflate the air-tube 10*a* by its restoring force and the front shape of the sponge 20*a* contours protrusively as well as curved face.

The above valve member V comprises two portions of a fixed body 30*a* and an elastic operating body 40*a* largely.

The fixed body 30*a* has a heat sealing portion 31*a* airtightly joined to the vent 11*a* outwardly, a circular jaw 34*a* protruding between upper and lower recesses 32*a*, 33*a* at the inner center, said jaw 34*a* including a slant face 35*a* and an inserting hole 36*a* sited on the top and the middle thereof, and several slots 37*a* radially formed on the underside of the jaw 34*a* and communicating with the interior of the air-tube 10*a*.

The elastic operating body 40*a* has upper and lower circular protrusions 41*a*, 42*a* respectively inserted into the the upper and lower recesses 32*a*, 33*a*, a connecting portion 43*a* between the upper and lower circular protrusions 41*a*, 42*a* having a smaller diameter than the inserting hole 36*a*, several vents 44*a* communicating with the slant face 35*a* and radially punched on the upper circular protrusion 41*a* and a tight tubercle 45*a* tightened to the jaw 34*a* on the upper circumference of the lower circular protrusion 42*a*.

The fixing body 30*a* is made of polyurethane as the synthetic resin and a elastic operating body 40*a* is made of silicon.

The top shape of a elastic operating body 40*a* contoured curved face and a pressing projection 46*a* is protrudes in the center thereof. In the engaging state of the fixing body 30*a* and elastic operating body 40*a*, the upper recess 32*a* is slightly higher sited upwardly than the upper circular protrusion 41*a* so as to prevent the operating body 40*a* from pressing by unexpected pressure.

Figure 11A:
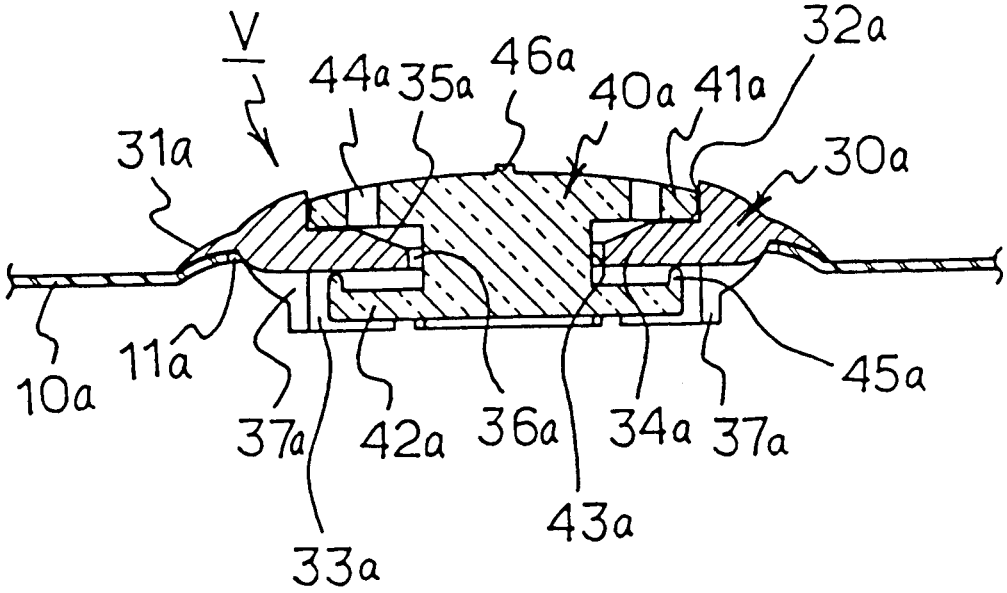
FIG. 11(A) is a sectional view showing a closed state of a valve member.

In such a valve member V, as shown in FIG. 11(A), the upper circular protrusion 41*a* of the operating body 40*a* and the tight tubercle 45*a* of the lower circular protrusion 42*a* are elastically tightened to the top and bottom of the jaw 34*a* in the fixed body 30*a*; the inserting hole 36*a* of the fixed body 30*a* and the connecting portion 43*a* of the operating body 40*a* keeps space therebetween; and the vents 44*a* of the operating body 40*a* and the slant face 35*a* of the jaw 34*a* keep communicated state.

Accordingly, as shown in FIG. 11(A), the valve member V is closed in ordinary time since the tight tubercle 45*a* of the operating body 40*a* is airtightly tightened on the bottom of the jaw 34*a* of the fixed body 30*a* thereby it intercepting the exhaustion and inhalation of air to the air-tube 10*a*.

Figure 11B:
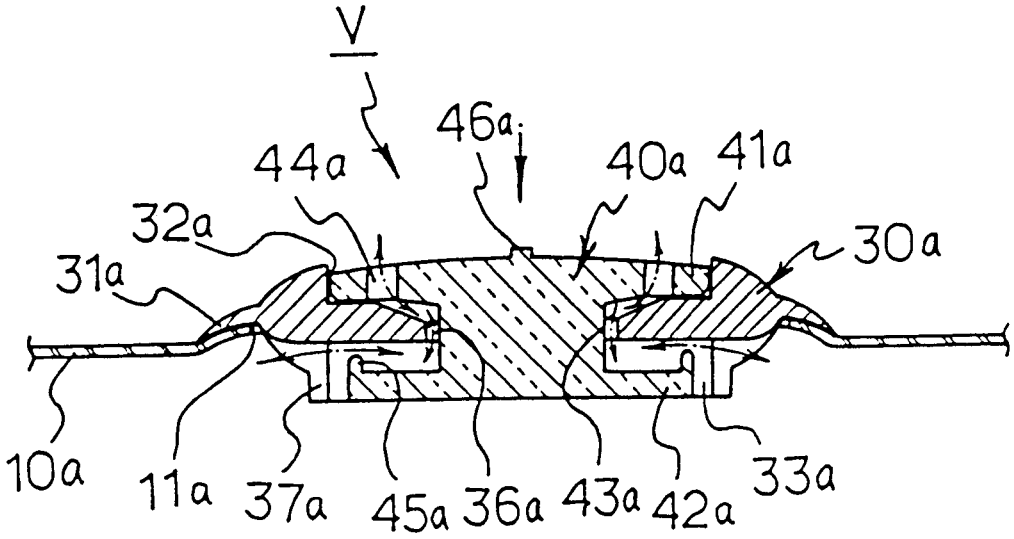
FIG. 11(B) is a sectional view showing an opened state of a valve member.
Figure 12:
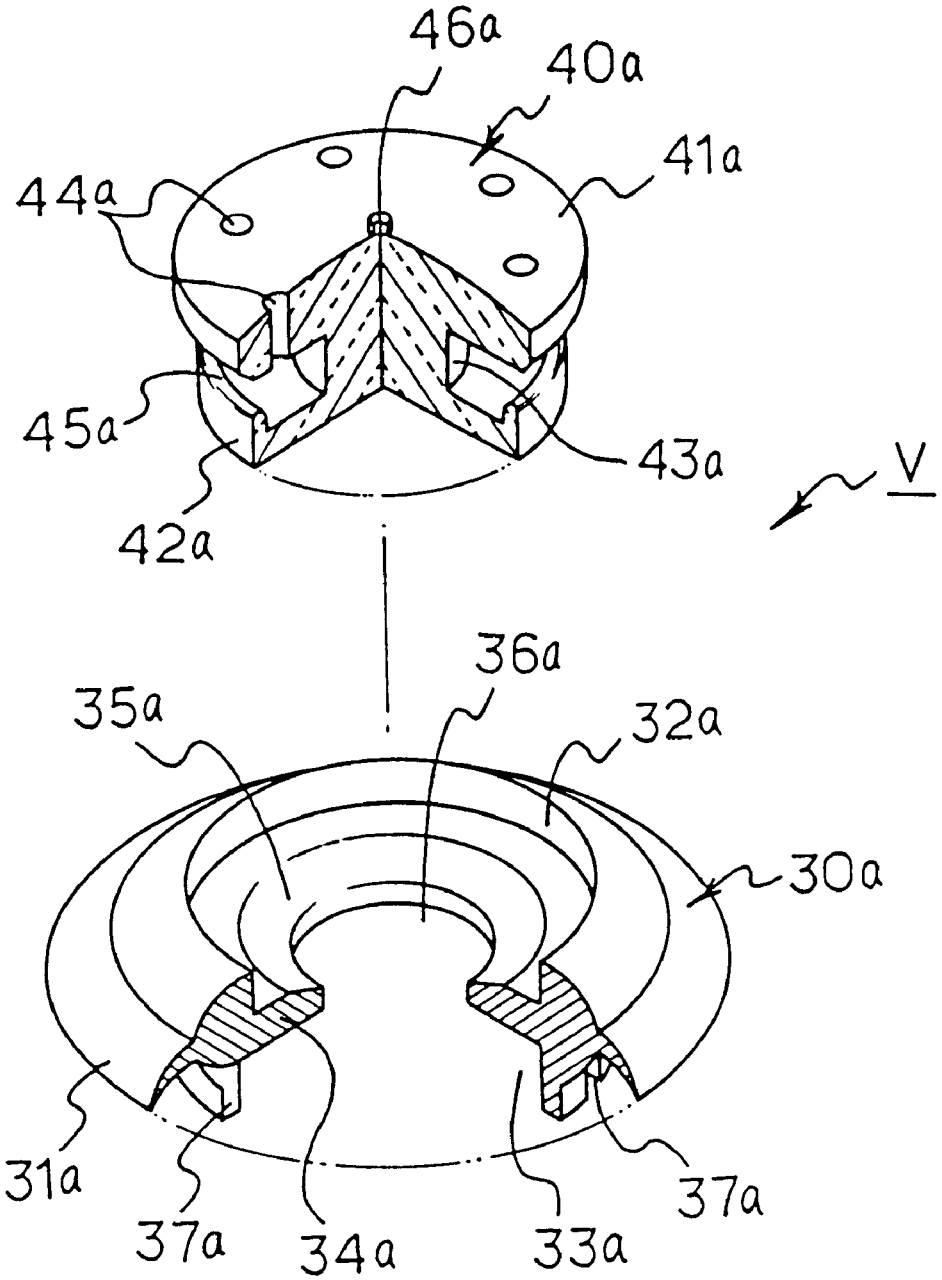

On the contrary, as shown in FIG. 11(B), when the pressing projection 46*a* of the operating body 40*a* is pressed to the arrow direction in case of necessity, the operating body 40*a* is elastically thrust to the pressing direction. Therefore, the tight tubercle 45*a* is taken apart from the bottom of the jaw 34*a* and thereby slots 37*a*, inserting hole 36*a* and vents 44*a* are all in communication with one another. That is, the exhaustion and inhalation of air to the air-tube 10*a* occurs as indicated by arrows since the valve member V is opened.

The brassiere of the third preferred embodiment composed as described above is worn such that shoulder bands are draped over one's shoulder and ends of the elastic bands are hooked on one's back. In this case, the brassiere cups 1*b* cover and protect both breasts with proper force naturally and also the brassiere cup 1*b* of the present invention has the following functions and distinguishing effects.

Figure 10A:
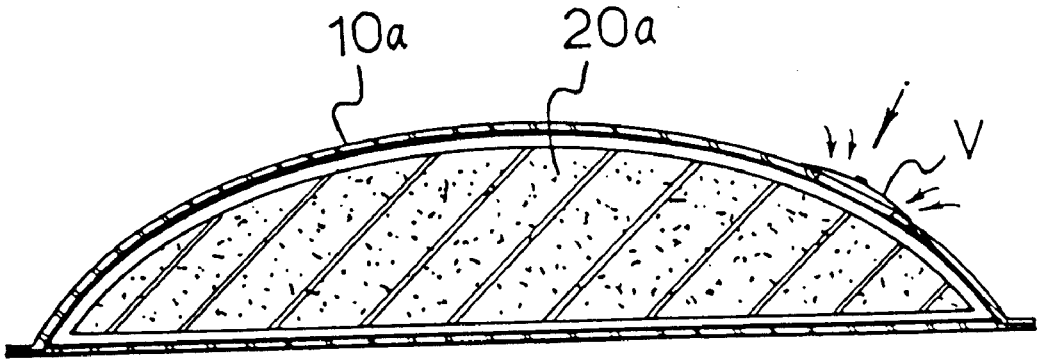
FIG. 10(A) is a sectional view showing an inflated air pad.

If the valve member V reaches an opened condition after the pressing projection 46*a* in the operating body 40*a* is forced and the air-tube 10*a* is not pressed, the highly elastic sponge 20*a* in the brassiere cup 1*b* restores its original state by a restoring force of its own. At the same time, air from outside is inhaled through the vent 44*a* of the valve member V by suction force occurring in the air-tube 10*a*. Accordingly, the air-tube 10*a* is inflated by the restoring force of sponge 20*a* with inhaling of outside air as shown in FIG. 10(A).

Figure 10B:
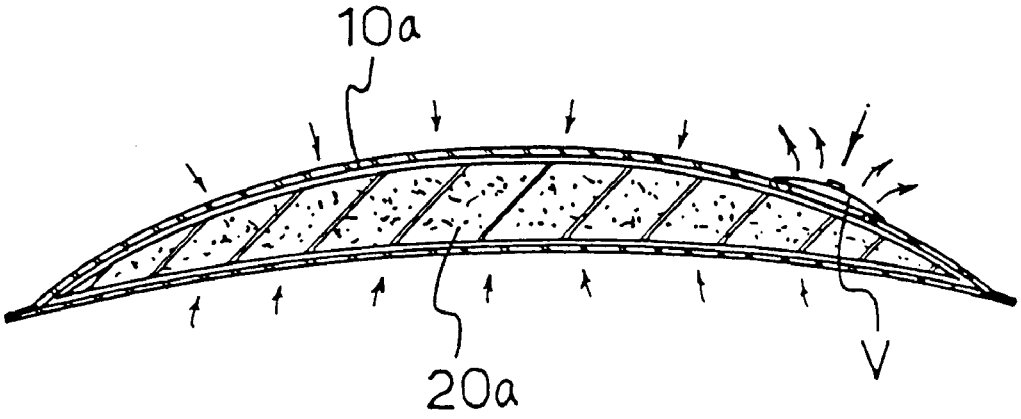
FIG. 10(B) is a sectional view showing a compressed air pad.

On the other hand, if the valve member V reaches an opened condition after the pressing projection 46*a* in the operating body 40*a* is forced and the air-tube 10*a* is pressed by forcing, the highly elastic sponge 20*a* in the brassiere cup 1*b* is compressed and simultaneously, the inner air is exhausted to outside through the vent 44*a* of the valve member V by pressure occurring inside of the air-tube 10*a*. That is, the air-tube 10*a* is deflated with exhausting of inside air as shown in FIG. 10(B).

As described above, the improved brassiere 1*a* showing in the third preferred embodiment of the present invention is not an air blowing type such as the first and second preferred embodiment but a natural inhaling type. Accordingly, any extra pump or manual pump for blowing air is not required and elasticity of the air-tube 10*a* can be freely and conveniently adjusted by manually opening and closing the valve member V with. Also, since the handling to inflate and deflate the air-tube 10*a* is simple, a wearer can properly and easily adjust the elasticity of said air-tube 10*a* according to her body shape.

Also, in the third embodiment of this invention, since the brassiere 1*a* is constructed such that the air-tube 10*a* is inflated by means of the highly elastic sponge 20*a* and breasts are supported, the wearer can feel enhanced and comfortable with the enlargement of cushion property.

Also, when the brassiere 1*a* of the present invention is worn, the wearer can get the remedial effect of infrared rays and any bad smell or germs arising due to secretion from the human body such as sweat, etc., can be removed and destroyed since ceramic material particle, antibiotics and deodorizer are added in air-tube 10*a* forming step.

The improved brassiere of the present invention is very useful to complement and revise drooped and small breasts and to enhance wearing feeling by endowing ventilating ability and hygienic ability.

The invention being thus described, it will be understood that variations and modifications may be made to the invention without altering the scope of the invention. All such modifications are intended to be included within the scope of the following claims.

What is claimed is:

1. A brassiere having brassiere cups of a conventional shape, said brassiere cups comprising:

an integral body with a first tube made of soft synthetic resin containing a predetermined amount of ceramic material;

an air feed valve for supplying air to said first tube; and a second tube separately formed from said first tube;

an air blowing pump for supplying air to said second tube, said first tube including a plurality of protrusions for finger-pressure therapy and a plurality of vents on an inner surface thereof, said feed valve including a valve body, a movable valve sheet housed within said valve body, alternately opening air intake holes formed in said valve body with at least one air hole formed on either side of said movable valve sheet, two springs, one spring being formed on each of opposing sides of said valve sheet, and two air pumps one, air pump being formed on each of opposing sides of said valve sheet, said valve sheet installed to vibrate up and down according to a wearer's movement so as to automatically supply air through said air holes to the interior of said feed valve, and wherein said second tube selectively inflates in accordance with degree of air-supply by said air blowing pump.

2. A brassiere having an air tube body formed inside of a brassiere cup said brassiere comprising:

an air-tube body inserted between inner and outer materials, and positioned in a lower part of said brassiere cup; and a check valve connected to one end of said air-tube body for selectively introducing air flow into said air-tube body.

3. A brassiere having conventional brassiere cups:

comprises an air-tube formed inside of said brassiere cup, said air-tube including at least one air vent therein;

an elastic sponge formed within said air-tube; and a valve member airtightly installed on said at least one air vent of said air-tube for selectively opening said at least one air vent.

4. The brassiere according to claim 3, wherein said valve member includes a fixed body and an elastic operating body;

said fixed body having a heat sealing portion at an outer dimension thereof and a circular jaw at an inner dimension thereof, said heat sealing portion being airtightly joined to an exterior of said air tube vent, and said circular jaw defining upper and lower recesses adjacent the inner dimension of said fixed body, said jaw including a slanted face and an inserting hole sited on top and middle thereof, and a plurality of slots communicating with the interior of said air-tube, and said elastic operating body having upper and lower circular protrusions, respectively, inserted into said upper and lower recesses, a connecting portion between said upper and lower circular protrusions having smaller diameter than the inserting hole, a plurality of vents in communication with the slant face and radially punched on said upper circular protrusion, and a tubercle tightened to said jaw on the upper circumference of the lower circular protrusion.

5. The brassiere according to claim 3, wherein said air-tube includes ceramic material particles, antibiotics, and deodorizer therein.

6. The brassiere according to claim 1, wherein said first tube is made of soft synthetic resin containing a predetermined amount of ceramic material, antibiotics, and deodorizer particles.

7. The brassiere according to claim 1, wherein said plurality of protrusions on said first tube are for finger-pressure therapy.

8. The brassiere according to claim 1, wherein said air blowing pumps are formed of a corrugated material.

9. The brassiere according to claim 1, wherein said pair of elastic springs are highly elastic.

10. The brassiere according to claim 2, wherein said inner and outer materials are formed of a ventilating fabric.

11. The brassier according to claim 2, wherein said air-tube body is positioned in the lower portion of said brassiere cup in order to support a lower portion of a breast.

12. The brassiere according to claim 2, wherein said air-tube body contains ceramic material, antibiotics, and deodorizer.

13. The brassiere according to claim 2, further comprising a removable cap for opening and closing said check valve, and an air tube connected to one end of said air tube body, wherein removal of said cap opens said air-tube body thereby enabling air flow access to said air-tube body.

* * * * *